US006006580A

United States Patent [19]

Frawley

[11] Patent Number: 6,006,580

[45] Date of Patent: Dec. 28, 1999

[54] AUTO BODY BENCH

[76] Inventor: Eric Frawley, 2958 SW. 21st. St., Gresham, Oreg. 97080

[21] Appl. No.: 09/074,131

[22] Filed: May 7, 1998

[51] Int. Cl.[6] ..... B21D 01/12

[52] U.S. Cl. ..... 72/458; 72/705; 248/166; 269/901

[58] Field of Search ..... 72/458, 705; 108/117, 108/124, 133; 248/162.1, 166, 432; 269/901, 905

[56] References Cited

U.S. PATENT DOCUMENTS

| | | | |
|---|---|---|---|
| 4,268,020 | 5/1981 | Wood | 269/901 |
| 4,705,247 | 11/1987 | Delmerico | 248/432 |
| 4,723,741 | 2/1988 | Doering | 248/166 |
| 4,880,194 | 11/1989 | Geise et al. | 269/901 |

*Primary Examiner*—Lowell A. Larson
*Attorney, Agent, or Firm*—Michael I Kroll

[57] ABSTRACT

An auto body bench (10) comprises a pair of scissor type leg assemblies (12). A first structure (14) is for connecting a first top end of each scissor type leg assembly (12) together. A second structure (16) is for connecting a second top end of each scissor type leg assembly (12) together. A facility (18) is for applying a twisting action between the scissor type leg assemblies (12). A system (20) is for adjusting the scissor type leg assemblies (12) between a closed collapsible position "A" to an opened useable position "B", so that the first connecting structure (14) and the second connecting structure (16) will support thereon a damaged small auto body part (22) removed from an automobile (24).

24 Claims, 5 Drawing Sheets

POSITION B
30
26
38
20
50
12
44
10
54
72
62
82
16
92
66
84
40
100
68
70
14
64
5
36
96
88
94
42
30
98
30
52
56
18
74
48
4
60
58
54
26
12
28
26
32
32

20
30
12
26
50
52
58
56
10
54

30
20
50
62
12
60
54
6
10
26

AUTO BODY BENCH

BACKGROUND OF THE INVENTION

1. Field of the Invention

The instant invention relates generally to workbenches and more specifically it relates to an auto body bench. The auto body bench is a collapsible, adjustable, scissor leg type bench having a foldable tray with a pry bar and leverage bar, accommodated with clamps and hammers, to perform a task or procedure called skinning a door, in which a damaged outer door panel is replaced with a new one. The auto body bench is designed for car doors, but can be also used for a variety of functions in an auto body shop, so as to replace the standard workbench now in use.

2. Description of the Prior Art

Almost all automobiles involved in a side collision will have door damage. Often, the inner door panels will be undamaged or will have only minor damage that may be easily straightened. The outer panel of a door is also known in the auto body trade as the door skin, or simply skin. This is the outside surface of the door.

In the auto body industry there is a procedure called skinning a door, where when the outside cosmetic skin being damaged is peeled off and a new one is attached in its place. The new panel or skin has a half inch flange on its perimeter which is folded in and crimped tight, so that it adheres to the old door shell or main frame.

Replacing an outer door panel is a common replacement job done in a body shop. If the skin is damaged to a great extent, it is almost always replaced. Door skins are about the easiest panels to replace. When the labor charge to straighten a door skin would amount to three or four hours, it would probably be less expensive to replace the panel with a new skin.

Generally, door skins are inexpensive. They can be quickly installed, when compared to an entirely new door. A new skin gives the appearance of a new door. Also, the skin can often be installed without removing the inner working parts of the door or window glass. However, the inside trim panel may need to be removed. The outer door handle is usually bolted to the door skin from the inside. Since only the outer panel is damaged, a new skin will be installed. This will save the time required to work out the damage.

Presently this task is accomplished on a variety of standard workbenches or work areas. The folding and crimping process is done by various hammers and dollies or blocks and leave the technician to wrestle with the door, while performing this awkward procedure. The standard workbench is usually used to work on smaller parts that have been removed from the car. By using the standard workbench, the parts are held at waist level, high enough to be easily worked on. The standard workbench is strong, stable, and made of steel, but is non-collapsible. A stationary shelf can be mounted beneath the standard workbench to store smaller tools, such as a tap and die set or electric drills, but cannot be folded up. While these units may be suitable for the particular purpose to which they address, they would not be as suitable for the purposes of the present invention as heretofore described.

SUMMARY OF THE INVENTION

A primary object of the present invention is to provide an auto body bench that will overcome the shortcomings of the prior art devices.

Another object is to provide an auto body bench that is a collapsible, adjustable, scissor leg type bench having a foldable tray with a pry bar and leverage bar, accommodated with clamps and hammer to perform a task or procedure called skinning a door, in which a damaged outer door panel is replaced with a new one.

An additional object is to provide an auto body bench that is designed for car doors, but can be also used for a variety of functions in an auto body shop, so as to replace the standard workbench now in use.

A further object is to provide an auto body bench that is simple and easy to use.

A still further object is to provide an auto body bench that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 9 is a plan view of the leverage bar, showing various blocks exploded therefrom.

FIG. 9A is a plan view of the shot bag with parts broken away.

Similar reference characters denote corresponding features consistently throughout the attached drawings.

DETAILED DESCRIPTION OF THE PREFERRED EMBODIMENTS

Figure 1:
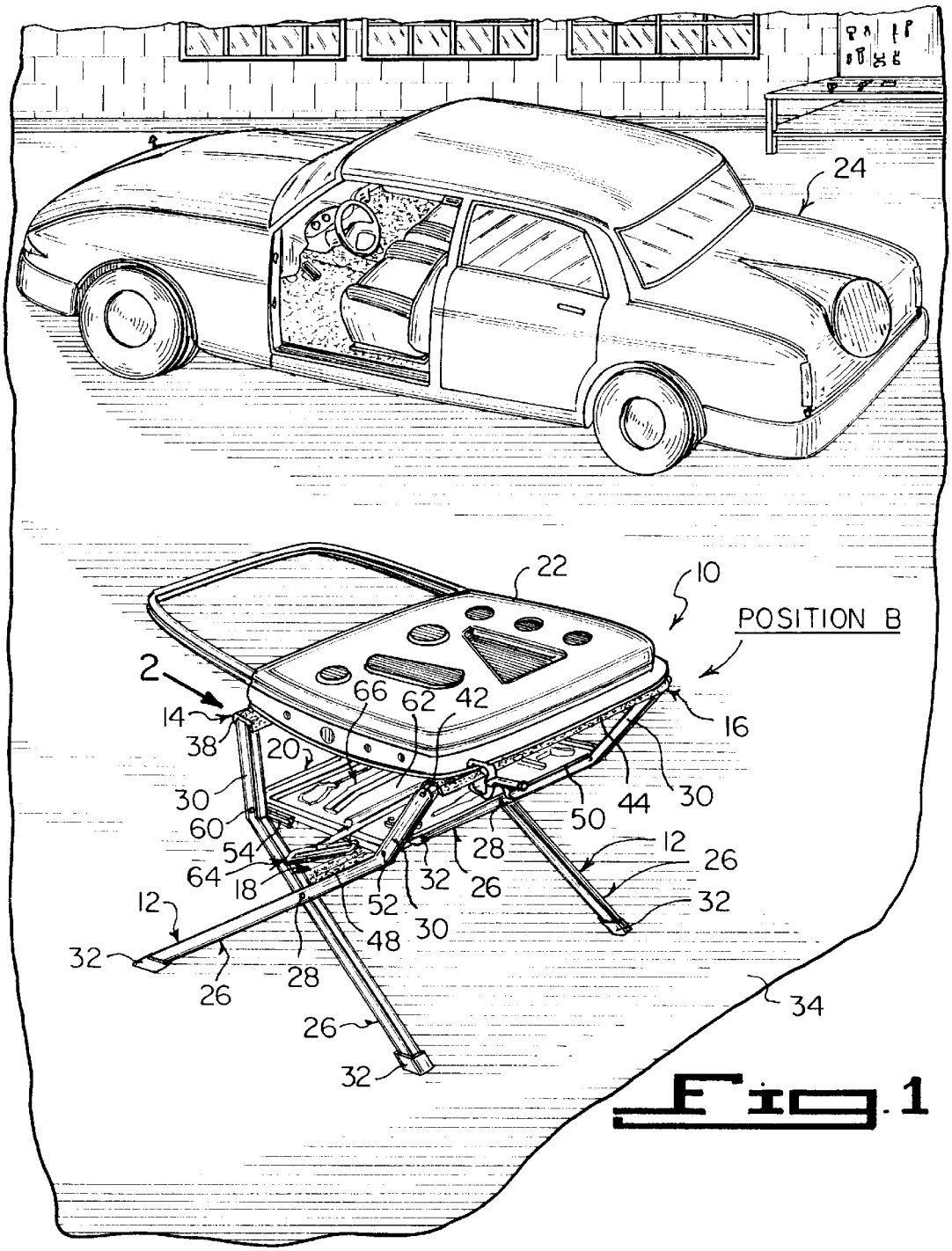
FIG. 1 is a front perspective view of the present invention in an opened position and in use in an auto body shop.
Figure 2:
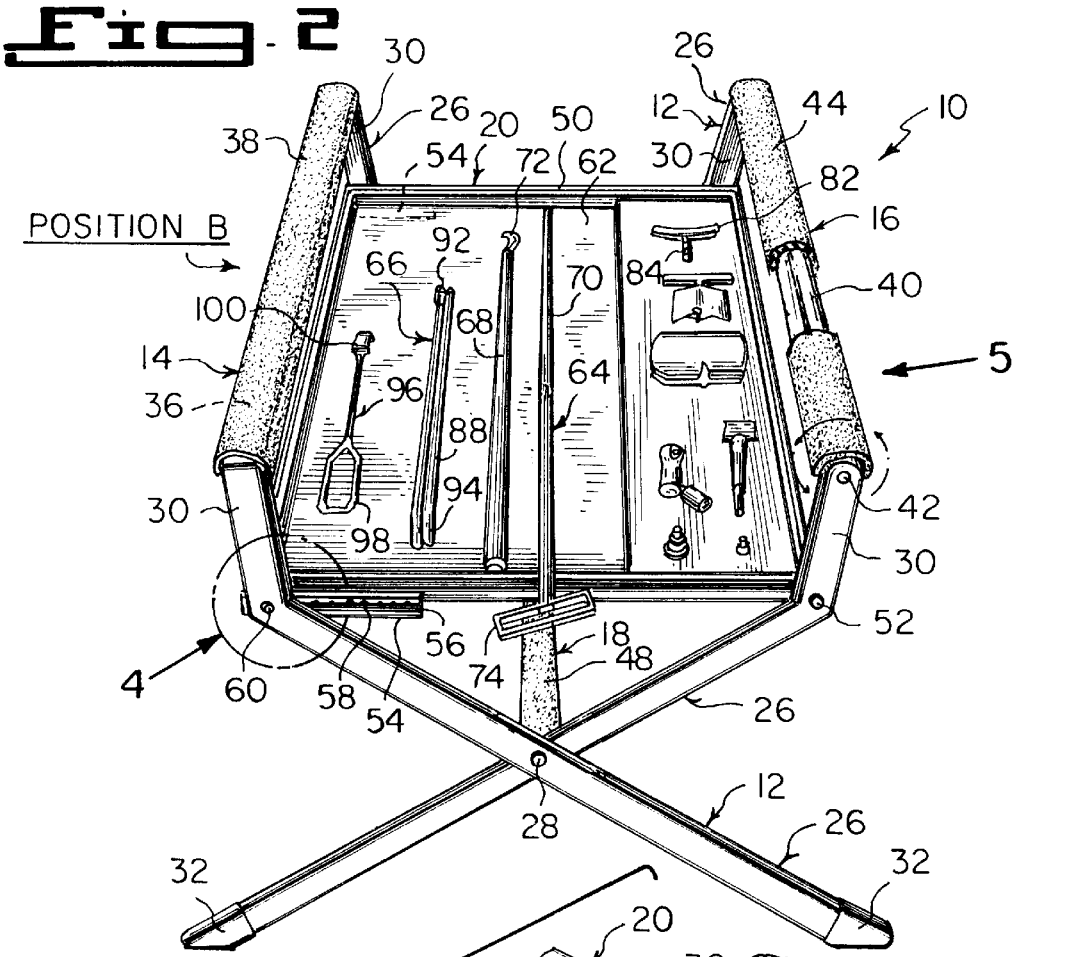
FIG. 2 is a side perspective view of the present invention per se, with parts broken away and in section, taken in the direction of arrow 2 in FIG. 1.
Figure 3:
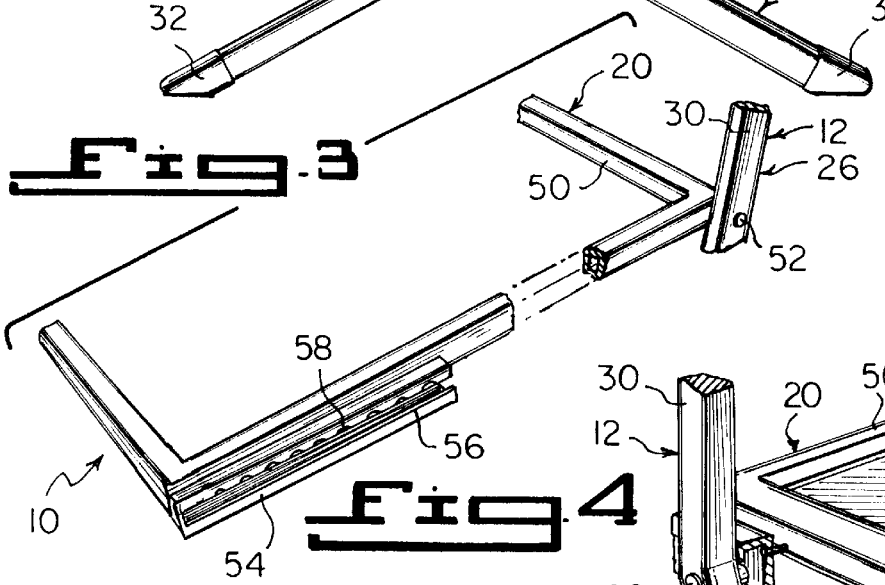
FIG. 3 is an enlarged side perspective view with parts broken away and in section, showing a portion of the box-shaped framework and one of the guide members in greater detail.
Figure 4:
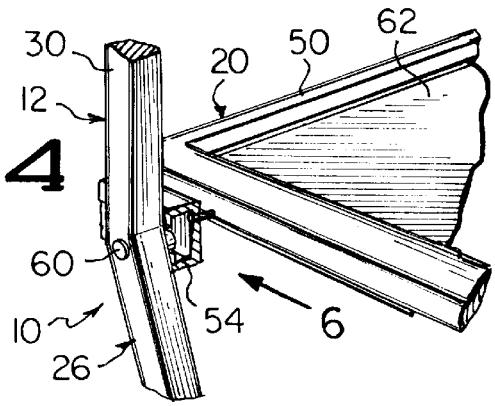
FIG. 4 is an enlarged perspective view of an area in FIG. 2 as indicated by arrow 4.
Figure 5:
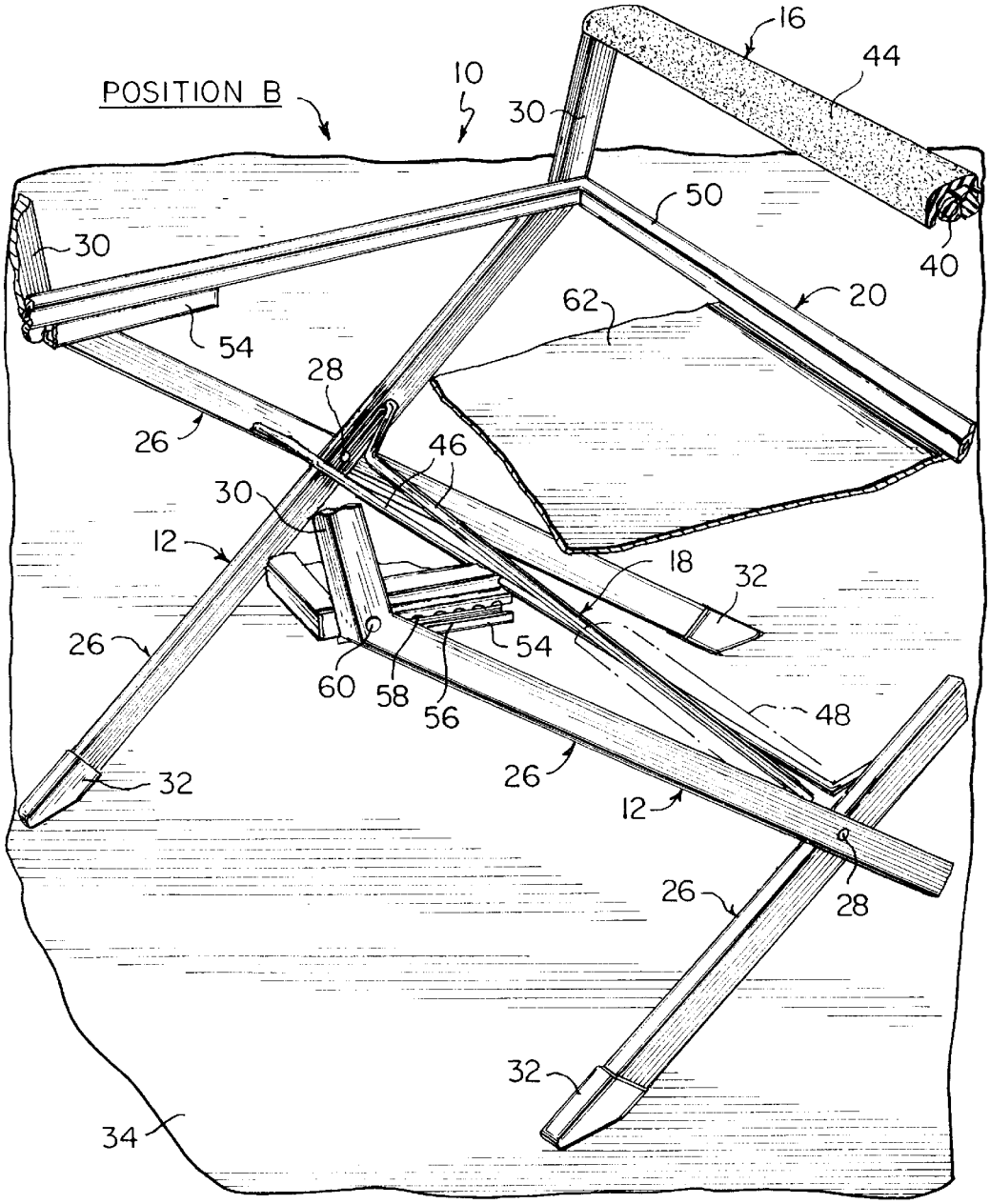
FIG. 5 is a further enlarged side perspective view with parts broken away and in section, taken in the direction of arrow 5 in FIG. 2.
Figure 6:
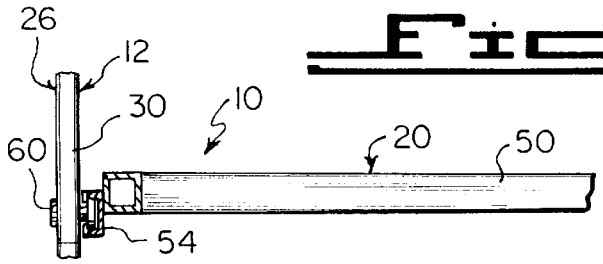
FIG. 6 is an elevational view with parts shown in section, taken in the direction of arrow 6 in FIG. 4 with the tray removed.
Figure 7:
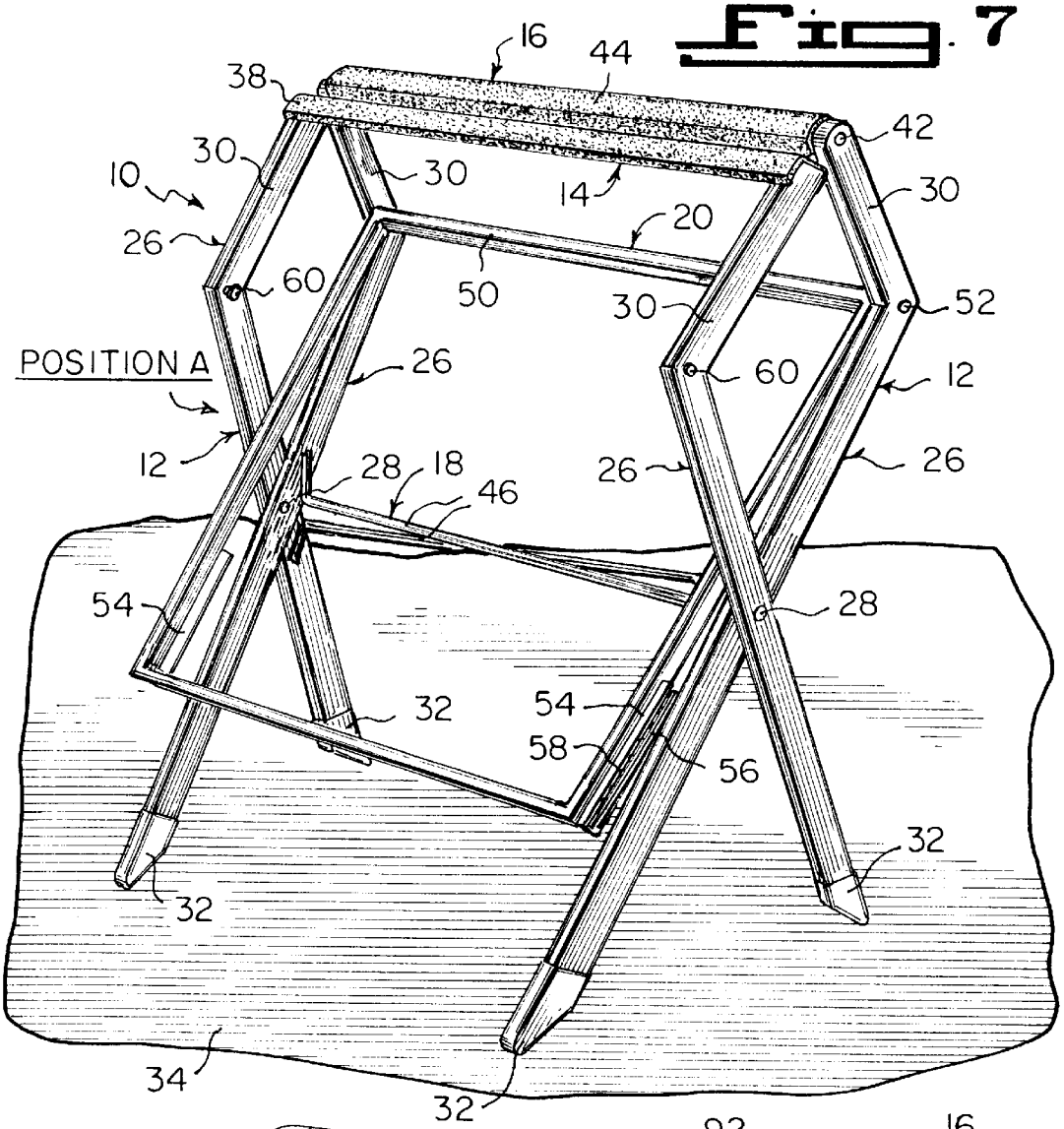
FIG. 7 is a front perspective view of the present invention in a closed collapsed position with parts and the tray removed.

Turning now descriptively to the drawings, in which similar reference characters denote similar elements throughout the several views, FIGS. 1 through 8 illustrate the present invention being an auto body bench 10. With regard to the reference numerals used, the following numbering is used throughout the various drawing figures.

A closed collapsible position of 10

B opened useable position of 10

10 auto body bench

12 scissor type leg assembly of 10

14 first connecting structure of 10

16 second connecting structure of 10

18 twisting facility of 10

20 adjusting system of 10

22 damaged small auto body part of 24

24 automobile

26 leg of 12

28 pivot pin of 12

30 bent top portion of 26

32 foot on 26

34 floor

36 crossbar of 14

38 pad of 14 on 36

40 anvil bar of 16

42 anvil bar axle pin of 16

44 pad of 16 on 40

46 torsion bar of 18

48 pad of 18 on 46

50 box-shaped framework of 20

52 framework axle pin of 20

54 guide member of 20

56 longitudinal slot in 54

58 upper notch in 56

60 guide pin of 20

62 tray of 20 on 50

64 leverage bar of 10

66 pry bar of 10

68 tubular member of 64

70 shaft of 64

72 hook member of 64 on 68

74 handle of 64 on 70

76 receiver sleeve of 64

78 bolt of 64 in 76

80 collar of 64 on 76

82 block of 64

84 shank on 82

86 optional spacer/spring of 64

88 arm of 66

90 notch in 88

92 foot of 66 on 88

94 handle of 66 on 88

96 link member of 66

98 loop end of 96

100 hook end of 96

The auto body bench 10 comprises a pair of scissor type leg assemblies 12. A first structure 14 is for connecting a first top end of each scissor type leg assembly 12 together. A second structure 16 is for connecting a second top end of each scissor type leg assembly 12 together. A facility 18 is for applying a twisting action between the scissor type leg assemblies 12. A system 20 is for adjusting scissor type leg assemblies 12 between a closed collapsible position "A" to an opened useable position "B", so that the first connecting structure 14 and the second connecting structure 16 will support thereon a damaged small auto body part 22 removed from an automobile 24.

Each scissor type leg assembly 12 consists of a pair of legs 26, having about a midway crossing point. A pivot pin 28 extends through the midway crossing point of the legs 26. Each leg 26 contains a bent top portion 30 and a foot 32 on a lower end to stabilize the leg 26 upon a floor 34.

The first connecting structure 14 includes a crossbar 36 and a pad 38 to cover the crossbar 36, so as to protect the damaged small auto body part 22 placed thereon. The second connecting structure 16 consists of an anvil bar 40. A pair of anvil bar axle pins 42 are for joining the anvil bar 40 in a rotational adjustable manner to the second top ends of the scissor type leg assemblies 12. A pad 44 covers the anvil bar 40 for procedures other than skinning, so as to protect the damaged small auto body part 22 placed thereon, when hammered and crimped.

The twisting facility 18 contains a pair of torsion bars 46 extending about midway across and connected between the scissor type leg assemblies 12. When the scissor type leg assemblies 12 are placed in the opened useable position "B", the torsion bars 46 will counter the inertia. A pad 48 covers the torsion bars 46.

The adjusting system 20 includes a box-shaped framework 50. A pair of framework axle pins 52 are for pivotally connecting one side of the box-shaped framework 50 about three quarters the way up between the scissor type leg assemblies 12. A pair of guide members 54 are attached to lower sides of the box-shaped framework 50 opposite from the framework axle pins 52. Each guide member 54 has a longitudinal slot 56 with a plurality of spaced apart upper notches 58. A pair of guide pins 60 are mounted about three quarters the way up on the scissor type leg assemblies 12 opposite from the framework axle pins 52. The guide pins 60 will slide in the slots 56 and lock into a choice of the upper notches 58 in the guide members 54, to accommodate different sized damaged small auto body parts 22. A tray 62 is connected to the box-shaped framework 50, for holding various tools needed for doing auto body repair work.

The auto body bench 10 further comprises a leverage bar 64 to engage with the box-shaped framework 50, to bear against the underside of the damaged small auto body part 22 which is being hammered. A pry bar 66 will engage with the second connecting structure 16 to serve as a crimper.

The leverage bar 64, as best seen in FIG. 9, includes a tubular member 68. A shaft 70 telescopically slides within the tubular member 68. A hook member 72 on a forward end of the tubular member 68 will engage with and slide upon the side opposite from the side of the box-shaped framework 50, with the framework axle pins 52. A handle 74 is on the shaft 70, to manually manipulate the leverage bar 64. A receiver sleeve 76 is provided, to slide anywhere upon the shaft 70. A bolt 78 in the receiver sleeve 76 locks the receiver sleeve 76 in place upon the shaft 70. A collar 80 is on the receiver sleeve 76. A block 82 is provided, having a shank 84. An optional spacer/spring 86 can fit over the shank 84 of the block 82, when the shank 84 is inserted into the collar 80, so as to allow the block 82 to bear against the damaged small auto body part 22. The block 82 can come in a variety of sizes, shapes and materials, to bear against different types of damaged small auto body parts 22.

Figure 8:
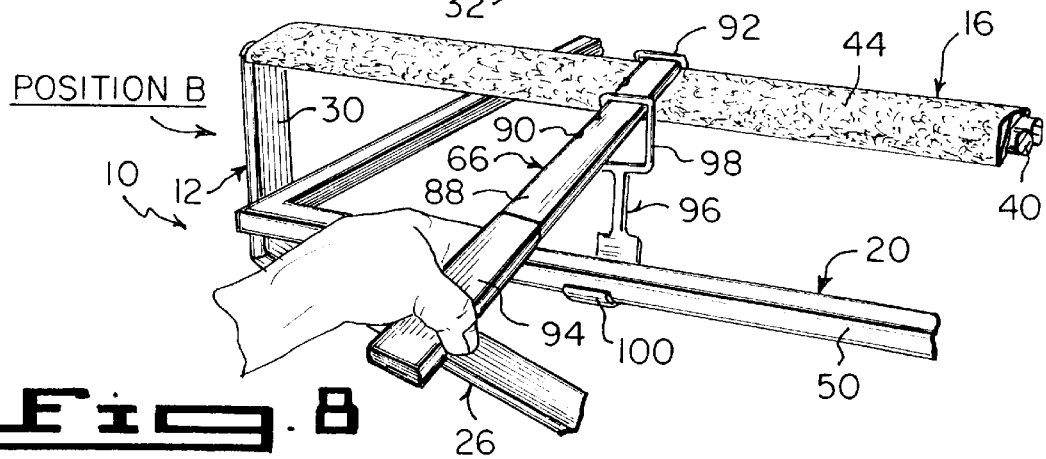
FIG. 8 is a perspective view of the pry bar in use.
Figures 5, 5A:
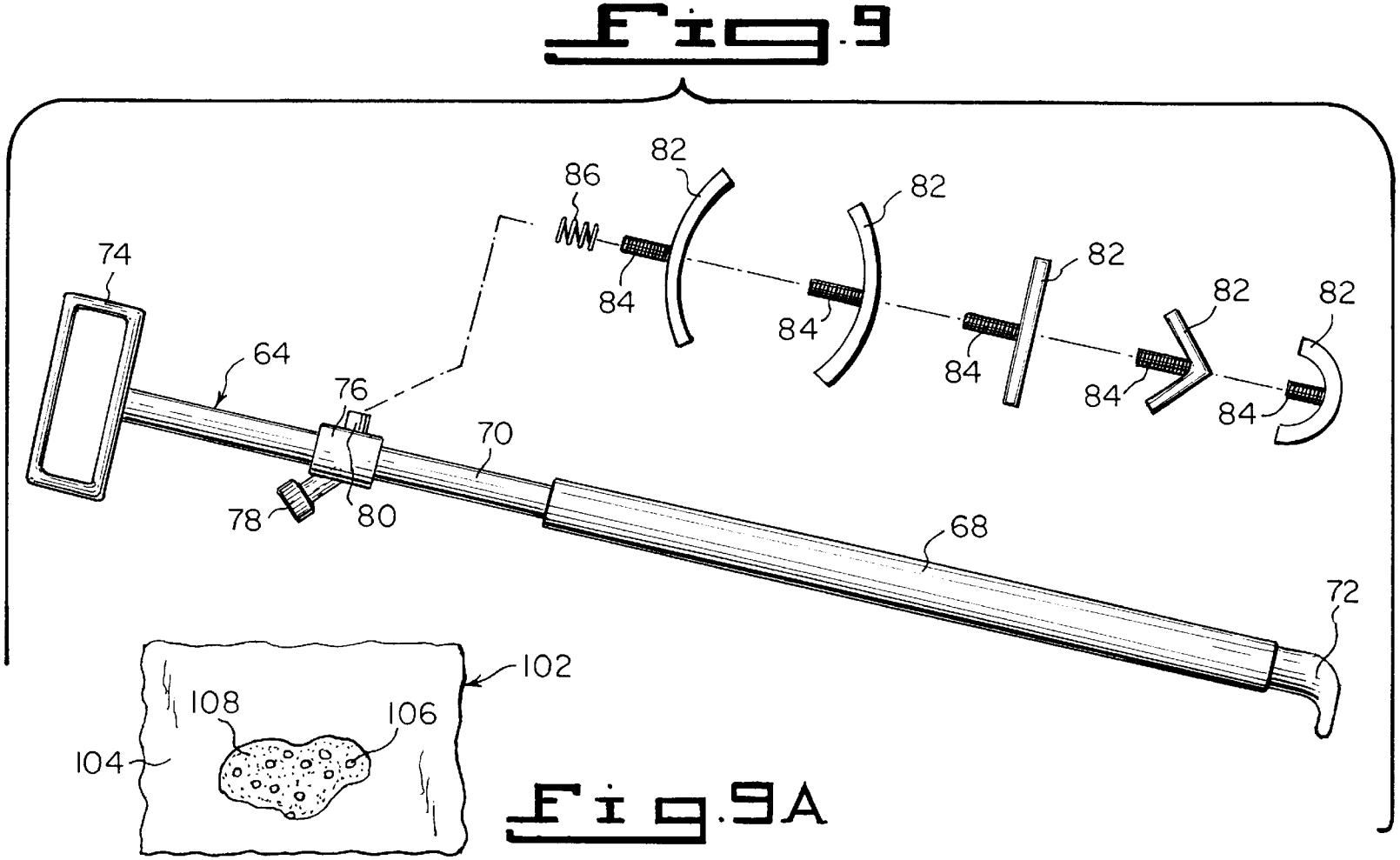

The pry bar 66, as best seen in FIG. 8, consists of an arm 88 having a plurality of notches 90 along one side thereof. A foot 92 is on a forward end of the arm 88 which extends over the second connecting means 16, to crimp a replacement skin on the small auto body part 22. A handle 94 is on a reward end of the arm 88, to manually operate the pry bar 66. A link member 96 is provided, having a loop end 98 and a hook end 100. The loop end 98 fits over the arm 88 in an adjustable manner, to engage with any one of the notches 90 on the arm 88, while the hook end 100 engages with the side of the box-shaped framework 50 with the framework axle pins 52.

FIG. 9A shows a shot bag 102 used between the block 82 and the damaged small auto body part 22, to conform to the more particular areas that the block 82 may not each. The shot bag 102 is made out of industrial fabric/rubber 104 and filled with small pellets 106 and sand 108.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An auto body bench comprising:

a) a pair of scissor type leg assemblies;

b) means for connecting a first top end of each said scissor type leg assembly together;

c) means for connecting a second top end of each said scissor type leg assembly together;

d) means for applying a twisting action between said scissor type leg assemblies; and e) means for adjusting said scissor type leg assemblies between a closed collapsible position to an opened useable position, so that said first connecting means and said second connecting means will support thereon a damaged small auto body part removed from an automobile, wherein said twisting means includes:

i) a pair of torsion bars extending about midway across and connected between said scissor type leg assemblies, so that when said scissor type leg assemblies are placed in the opened useable position, said torsion bars will counter the inertia; and ii) a pad to cover said torsion bars.

2. An auto body bench as recited in claim 1, wherein each said scissor type leg assembly includes a pair of legs having about a midway crossing point and a pivot pin extending through said midway crossing point of said legs.

3. An auto body bench as recited in claim 2, wherein each said leg includes:

a) a bent top portion; and b) a foot on a lower end to stabilize said leg upon a floor.

4. An auto body bench as recited in claim 3, wherein said first connecting means includes:

a) a crossbar; and b) a pad to cover said crossbar, so as to protect the damaged small auto body part placed thereon.

5. An auto body bench as recited in claim 4, wherein said second connecting means includes:

a) an anvil bar;

b) a pair of anvil bar axle pins for joining said anvil bar in a rotational adjustable manner to the second top ends of said scissor type leg assemblies; and c) a pad to cover said anvil bar for procedures other than skinning, so as to protect the damaged small auto body part placed thereon, when hammered and crimped.

6. An auto body bench as recited in claim 5, wherein said twisting means includes:

a) a pair of torsion bars extending about midway across and connected between said scissor type leg assemblies, so that when said scissor type leg assemblies are placed in the opened useable position, said torsion bars will counter the inertia; and b) a pad to cover said torsion bars.

7. An auto body bench as recited in claim 6, wherein said adjusting means includes:

a) a box-shaped framework;

b) a pair of framework axle pins for pivotally connecting one side of said box-shaped framework about three quarters the way up between said scissor type leg assemblies;

c) a pair of guide members attached to lower sides of said box-shaped framework opposite from said framework axle pins, each said guide member having a longitudinal slot with a plurality of spaced apart upper notches; and d) a pair of guide pins mounted about three quarters the way up on said scissor type leg assemblies opposite from said framework axle pins, whereby said guide pins will slide in said slots and lock into a choice of said upper notches in said guide members to accommodate different sized damaged small auto body parts.

8. An auto body bench as recited in claim 7, wherein said adjusting means further includes a tray connected to said box-shaped framework, for holding various tools needed for doing auto body repair work.

9. An auto body bench as recited in claim 8, further including:

a) a leverage bar to engage with said box-shaped framework to bear against the underside of the damaged small auto body part which is being hammered; and b) a pry bar to engage with said second connecting means to serve as a crimper.

10. An auto body bench as recited in claim 9, wherein said leverage bar includes:

a) a tubular member;

b) a shaft which telescopically slides within said tubular member;

c) a hook member on a forward end of said tubular member to engage with and slide upon the side opposite from the side of said box-shaped framework with said framework axle pins;

d) a handle on said shaft to manually manipulate said leverage bar;

e) a receiver sleeve which slides anywhere upon said shaft;

f) a bolt in said receiver sleeve to lock said receiver sleeve in place upon said shaft;

g) a collar on said receiver sleeve;

h) a block having a shank; and i) an optional spacer/spring to fit over the threaded shank of said block, when said shank is inserted into said collar, so as to allow said block to bear against the damaged small auto body part.

11. An auto body bench as recited in claim 10, wherein said block can come in a variety of sizes, shapes and materials to bear against different types of damaged small auto body parts.

12. An auto body bench as recited in claim 11, wherein said pry bar includes:

a) an arm having a plurality of notches along one side thereof;

b) a foot on a forward end of said arm which extends over said second connecting means, to crimp a replacement skin on the small auto body part;

c) a handle on a reward end of said arm to manually operate said pry bar; and d) a link member having a loop end and a hook end, whereby said loop end fits over said arm in an adjustable manner to engage with any one of said notches on said arm, while said hook end engages with the side of said box-shaped framework with said framework axle pins.

13. An auto body bench as recited in claim 10, further including a shot bag used between said block and the damaged small auto body part, to conform to the more particular areas that said block may not reach, wherein said shot bag is made out of industrial fabric/rubber and filled with small pellets and sand.

14. An auto body bench comprising:

a) a pair of scissor type leg assemblies;

b) means for connecting a first top end of each said scissor type leg assembly together;

c) means for connecting a second top end of each said scissor type leg assembly together;

d) means for applying a twisting action between said scissor type leg assemblies; and e) means for adjusting said scissor type leg assemblies between a closed collapsible position to an opened useable position so that said fist connecting means and said second connecting means will support thereon a damaged small auto body Dart removed from an automobile wherein said adjusting means includes:

i) a box shaped framework;

ii) a pair of framework axle pins for pivotally connecting one side of said box-shaped framework about three quarters the way up between said scissor type leg assemblies;

iii) a pair of guide members attached to lower sides of said box-shaped framework opposite from said framework axle pins, each said guide member having a longitudinal slot with a plurality of spaced apart upper notches; and iv) a pair of guide pins mounted about three quarters the way up on said scissor type leg assemblies opposite from said framework axle pins, whereby said guide pins will slide in said slots and lock into a choice of said upper notches in said guide members to accommodate different sized damaged small auto body parts.

15. An auto body bench as recited in claim 14, wherein each said scissor type leg assembly includes:

a) a pair of legs having about a midway crossing point; and b) a pivot pin extending through said midway crossing point of said legs.

16. An auto body bench as recited in claim 15, wherein each said leg includes:

a) a bent top portion; and b) a foot on a lower end to stabilize said leg upon a floor.

17. An auto body bench as recited in claim 14, wherein said first connecting means includes:

a) a crossbar; and b) a pad to cover said crossbar, so as to protect the damaged small auto body part placed thereon.

18. An auto body bench as recited in claim 14, wherein said second connecting means includes:

a) an anvil bar;

b) a pair of anvil bar axle pins for joining said anvil bar in a rotational adjustable manner to the second top ends of said scissor type leg assemblies; and c) a pad to cover said anvil bar for procedures other than skinning, so as to protect the damaged small auto body part placed thereon, to be hammered and crimped.

19. An auto body bench as recited in claim 14, wherein said adjusting means further includes a tray connected to said box-shaped framework, for holding various tools needed for doing auto body repair work.

20. An auto body bench as recited in claim 14, further including:

a) a leverage bar to engage with said box-shaped framework to bear against the underside of the damaged small auto body part which is being hammered; and b) a pry bar to engage with said second connecting means to serve as a crimper.

21. An auto body bench as recited in claim 20, wherein said leverage bar includes:

a) a tubular member;

b) a shaft which telescopically slides within said tubular member;

c) a hook member on a forward end of said tubular member to engage with and slide upon the side opposite from the side of said box-shaped framework with said framework axle pins;

d) a handle on said shaft to manually manipulate said leverage bar;

e) a receiver sleeve which slides anywhere upon said shaft;

f) a bolt in said receiver sleeve to lock said receiver sleeve in place upon said shaft;

g) a collar on said receiver sleeve;

h) a block having a shank; and i) an optional spacer/spring to fit over the shank of said block, when said shank is inserted into said collar, so as to allow said block to bear against the damaged small auto body part.

22. An auto body bench as recited in claim 21, wherein said block can come in a variety of sizes and shapes and materials to bear against different types of damaged small auto body parts.

23. An auto body bench as recited in claim 21, further including a shot bag used between said block and the damaged small auto body part, to conform to the more particular areas that said block may not reach, wherein said shot bag is made out of industrial fabric/rubber and filled with small pellets and sand.

24. An auto body bench as recited in claim 20, wherein said pry bar includes:

a) an arm having a plurality of notches along one side thereof;

b) a foot on a forward end of said arm which extends over said second connecting means, to crimp a replacement skin on the small auto body part;

c) a handle on a reward end of said arm to manually operate said pry bar; and d) a link member having a loop end and a hook end, whereby said loop end fits over said arm in an adjustable manner to engage with any one of said notches on said arm, while said hook end engages with the side of said box-shaped framework with said framework axle pins.

* * * * *